US005238274A

United States Patent [19]

Becker et al.

[11] Patent Number: 5,238,274

[45] Date of Patent: Aug. 24, 1993

[54] DEVICE FOR LOCKING AND UNLOCKING CLOSED DOORS TO THE INTERIOR OF A MOTOR VEHICLE

[75] Inventors: Rainer Becker, Stutzheim-Offenheim; Eckhard Ursel, Buehl; Peter-Josef Bauer, Buehl; Uwe Schaper, Buehl-Vimbuch, all of Fed. Rep. of Germany

[73] Assignee: Robert Bosch GmbH, Stuttgart, Fed. Rep. of Germany

[21] Appl. No.: 838,753

[22] PCT Filed: Sep. 6, 1990

[86] PCT No.: PCT/DE90/00679

§ 371 Date: Mar. 30, 1992

§ 102(e) Date: Mar. 30, 1992

[87] PCT Pub. No.: WO91/04384

PCT Pub. Date: Apr. 4, 1991

[30] Foreign Application Priority Data

Sep. 14, 1989 [DE] Fed. Rep. of Germany ..... 3930698
May 15, 1990 [DE] Fed. Rep. of Germany ..... 4015522

[51] Int. Cl.[5] ..... E05C 3/26; E05B 47/00
[52] U.S. Cl. ..... 292/201; 292/216
[58] Field of Search ..... 292/201, 216, 280

[56] References Cited

U.S. PATENT DOCUMENTS 4,667,990 5/1987 Quantz ..... 292/201
4,763,936 8/1988 Rogakos et al. ..... 292/201
4,969,672 11/1990 Childs et al. ..... 292/201
4,978,153 12/1990 Hirsch et al. ..... 292/201
5,007,261 4/1991 Quantz ..... 292/201 X
5,020,838 6/1991 Fukumoto ..... 292/201

FOREIGN PATENT DOCUMENTS 217169 9/1986 European Pat. Off. .
3120000 12/1982 Fed. Rep. of Germany .
3516991 11/1985 Fed. Rep. of Germany .

*Primary Examiner*—Richard E. Moore
*Attorney, Agent, or Firm*—Michael J. Striker

[57] ABSTRACT

A device is suggested which serves to lock and unlock closed doors of a motor vehicle. The device comprises a lock which is assigned to every door, can be actuated with a key and whose locking element is swivelably supported at the door and whose retainers, which cooperate with the latter, are arranged near the door opening so as to be fixed with respect to the body of the vehicle. The locking element is a structural component part which is spring-loaded relative to the unlocking position and engages behind the pin-like retainers with a hook-shaped projection in its locking position. The locking element has two catches which together enclose an angle with reference to the swivel axis of the locking element, which catches cooperate with counter-catches of a swivelable latch element which are spring-loaded relative to the catch position. To actuate a device constructed in such a way by motor as well, the lock has an actuating element which can be activated by motor, swivels the locking element into its locking position for locking the door and moves the latch element against the spring force for unlocking door and in so doing disengages the catches and counter-catches.

35 Claims, 11 Drawing Sheets

75
73
94
12
88
96
78
80
74
84
46
108
10
76
90
32
14
11
18
20
16
64
22
92
30
52
27
102
10
50
112
55
54
72
110
106
104
98
100
112
112
10
10

DEVICE FOR LOCKING AND UNLOCKING CLOSED DOORS TO THE INTERIOR OF A MOTOR VEHICLE

BACKGROUND OF THE INVENTION

The present invention relates to a device for locking and unlocking closed doors to the interior of a motor vehicle.

In particular it relates to a device having a lock assigned to every door with a locking element swivelably supported at the door and having retaining means cooperating with the latter, wherein the locking element is a structural component which is spring-loaded relative to the unlocking position and engages behind the pin-like retaining means in its locking position.

Such a device is already known commercially, but in this device the actuation is effected exclusively manually. There are already devices for locking and unlocking closed motor vehicle doors by motor, but in these cases the locking element or a power take-off element of a drive device is reciprocated in a straight line (DE-OS 31 20 000, DE-OS 35 16 991). This is not provided in the device according to the invention.

In locks of doors to the passenger compartment of motor vehicles a plurality of operating positions are conventionally and generally known:

A The so-called unlocking position in which the door can be pulled opened from the outside or pushed open from the inside without actuating additional mechanisms.

B The first closing stage, also called the safety or lean-against position, in which the almost closed door is incorrectly locked but is still held closed. It is not possible to open the door by pulling or pushing in this position.

C The second closing stage or locked position in which the door is correctly closed and locked and cannot be opened simply by pulling or pushing.

These three lock operating positions can also be achieved in locks with a construction differing from the lock concerned here by a correspondingly adapted motorized actuating drive.

If the above-mentioned operating position C can be achieved in all doors simultaneously by the closing movement of a key inserted into a lock, this is known as a so-called central locking system.

If all locks of the doors to the passenger compartment of a motor vehicle are in the operating position pertaining to the second locking stage, this is also designated as the anti-theft position.

In the device according to the present application, on the other hand, central locking (operating position D) is understood as an operating state of the entire closing system in which all door locks are in operating position C, but where it is not possible to open the doors from the outside because then the actuating lever or actuating button on the door handle does not function. However, every door can be opened easily from inside the passenger compartment if the so-called locking button or a corresponding lever located on the door is actuated first.

Finally, there is another operating position in the device according to the present application for protection in which the doors can only be unlocked by electric motor actuation. This position can also not be changed, e.g. when a window pane is broken in and the locking button is pulled. Since this operating position can only be fed to so-called central electronics and from the latter to an actuating motor assigned to the actuating element from the outside via the door key and can likewise only be changed—with the exception of an emergency unlocking means still to be discussed—via the actuating motor, this operating position is to be designated here as the anti-theft position (operating position E).

SUMMARY OF THE INVENTION

Accordingly, it is an object of the present invention to provide a device for locking and unlocking closed doors to the interior of a motor vehicle, which avoids the disadvantages of the prior art.

In keeping with these objects and with others which will become apparent hereinafter, one feature of the present invention resides, in a device for locking and unlocking closed doors, in which the lock has a motor-activated actuating element which swivels the locking element into its locking position for locking the door and moves the latch element against a spring force for unlocking the door and in so doing disengages catch means and counter-catch means of the device.

When the device is designed in accordance with the present invention, it has the advantage that a swivelable locking element and, in addition, a securing, likewise swivelable latch element are movable in a motorized manner corresponding to the requirements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
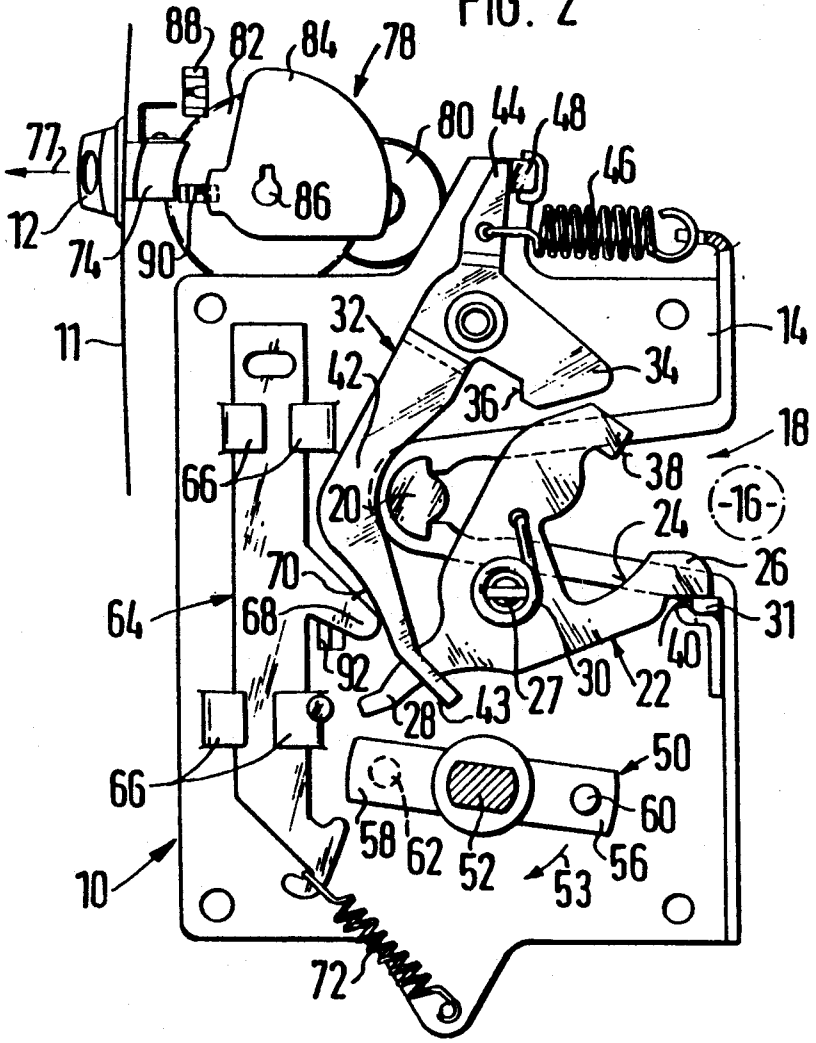
FIG. 2 shows the lock according to FIG. 1 in an enlarged view, the actuating element being simplified.
Figure 5:
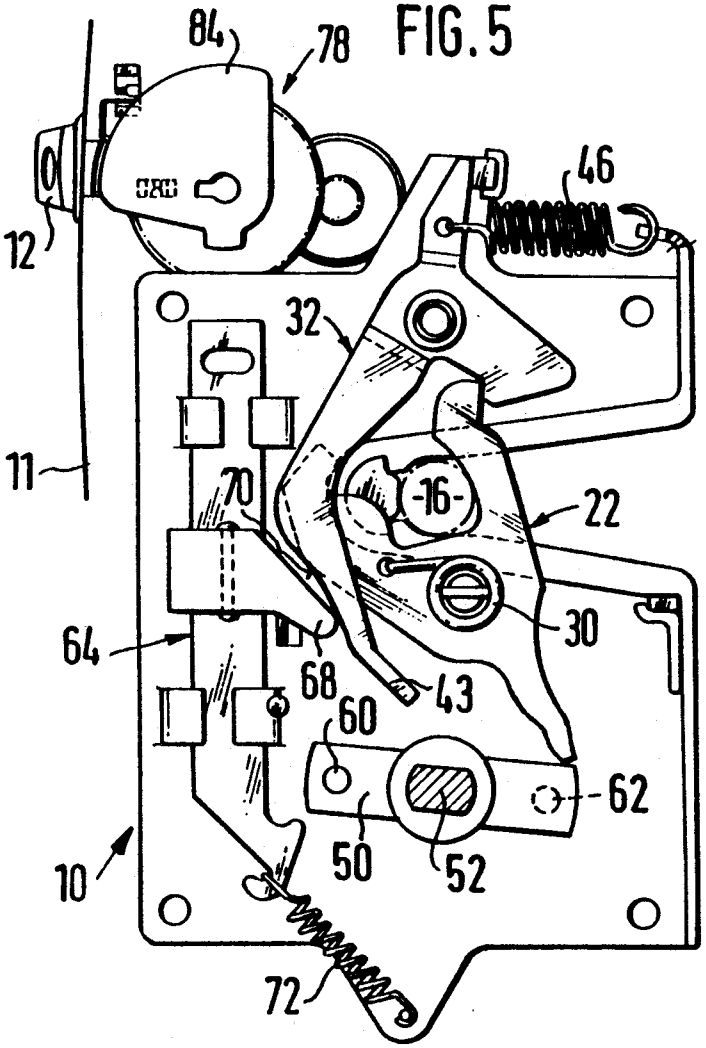
FIG. 5 shows the lock according to FIG. 2 in operating position C, the door handle being blocked so that operating position E results.

According to the embodiment example, four door locks 10 belong to a locking and unlocking device for the doors to the passenger compartment of a motor vehicle, one of which, namely the door lock arranged at the driver's door 11, has been drawn graphically. The driver's door 11 is indicated along a brief partial area and is provided with a door handle 12. The door lock 10 has a supporting plate 14 at which the other parts belonging to the lock are arranged. A so-called closing pin 16 which is arranged in the area of the door opening at the frame of the door and is securely connected with the latter is also part of the door lock 10. The closing pin 16 is arranged in such a way that when the door is closed it arrives in a channel 18 of the supporting plate 14, which channel 18 is open at the edge and extends so as to become narrower. An elastic buffer 20 which is acted upon and deformed by the closing pin 16 when the door is closed is arranged at the end of the channel 18. A locking element 22 is swivelably supported at the supporting plate 14. The locking element 22 is constructed so as to be somewhat plate-shaped and has a cut out portion 24 which is open at the edge so that a hook-like arm 26 results (FIG. 2). With respect to the swivel axis 27 of the locking element 22, a lever 28 is located approximately opposite the cut out portion 24 which is open at the edge. The locking element 22 is spring-loaded in the clockwise direction via a pretensioned leg spring 30 and contacts a stop 31 in the shown operating position from which the locking element 22 is swivelable opposite the clockwise direction and against the force of the leg spring 30.

Figure 1:
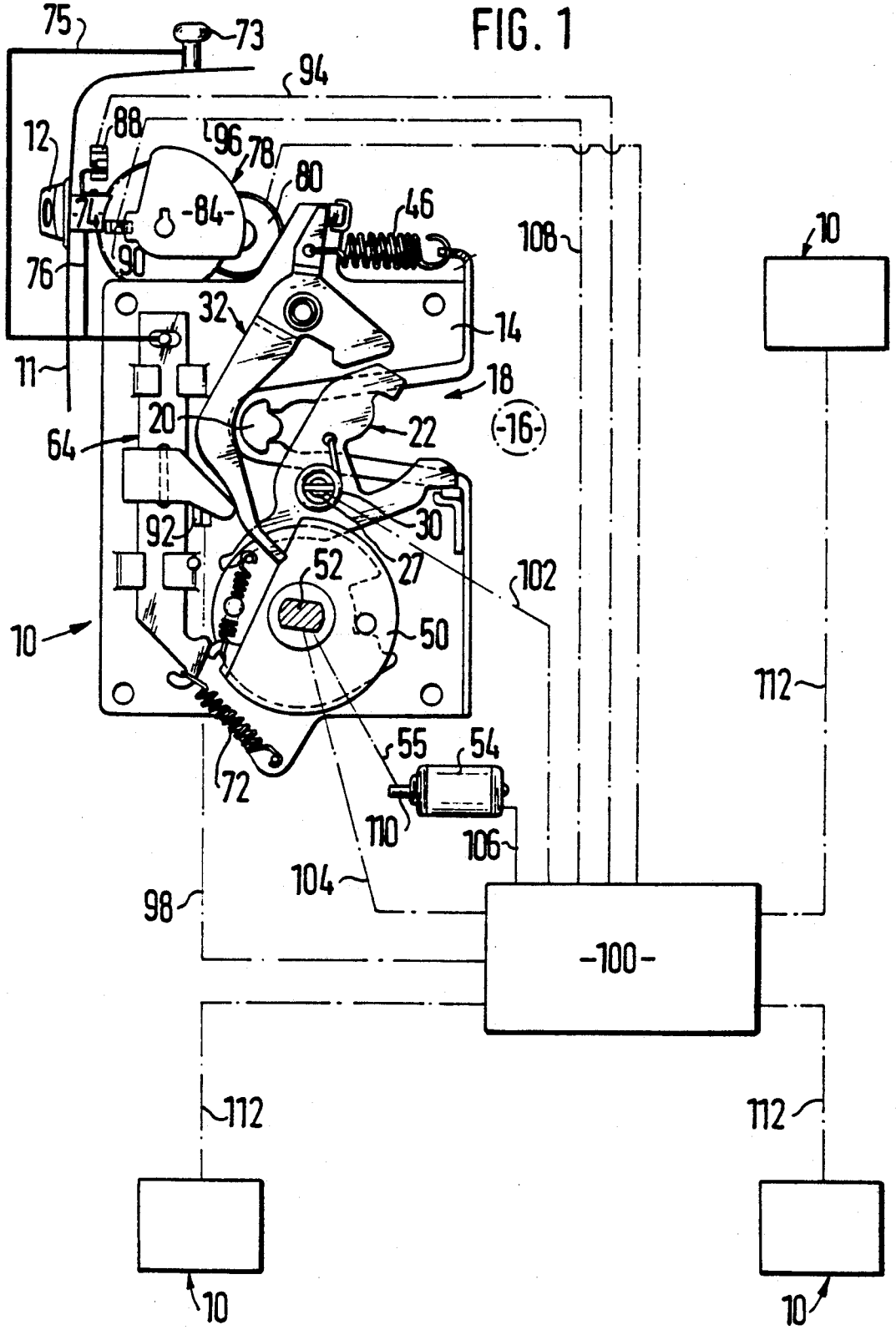
FIG. 1 shows a basic view of a device according to the invention, but in which one lock on the driver's door is shown in a substantially graphic manner and in its operating position A.

Further, the lock 10 has a latch element 32 which is likewise swivelably supported at the supporting plate 14. The latch element 32 has a first swivel arm 34 at which counter-catch means 36 are formed at a correspondingly aligned edge. When operating the device, the counter-catch means 36 can cooperate with edges 38 and 40 of the locking element 22 which are constructed as catch means. (See FIGS. 2 and 3). Further, the latch element 32 has a second swivel arm 42 which is bent at a right angle out of the drawing plane relative to the first swivel arm 34 and extends further in a plane which is nearer to the observer than the plane in which the locking element 22 is situated. The free end of the second swivel arm 42 extends until the area of the lever 28 of the locking element 22. A tension spring 46 which is anchored at the supporting plate 14 and tends to swivel the latch element 32 in the clockwise direction acts on a tab 44 of the latch element 22. In the operating position shown in FIG. 2, the tab 44 is supported at a buffer 48 of the supporting plate 14 so that the operating position of the latch element 32 shown here is first maintained. Finally, an actuating element 50 is supported in the supporting plate 14 (FIG. 2) and is formed as a two-armed lever and is securely connected with a shaft 52 which can be driven via an electrical lock or drive motor 54 (FIG. 1) in the direction of the arrow 53. The drive connection between the shaft 52 and the drive motor 54 is indicated by a line 55 drawn in FIG. 1. It is noted that the actuating element 50 is drawn in FIGS. 2 to 7 in a greatly simplified manner for the sake of clarity. In the area of the free ends of the lever arms 56 and 58, two pins are anchored, one of which pins 60 extends toward the observer of the drawing, while the other pin 62 projects out of the arm 58 toward the supporting plate 14. The lever arms 56 and 58 are arranged in such a way that the swivel plane of the arms 56, 58 is located between the lever 28 of the locking element 22 and the second swivel arm 42 of the latch element 32. The orbits of the two pins 60 and 62 are dimensioned in such a way that one pin 60 cooperates with the second swivel arm 42 while the pin 62 communicates with the lever 28.

Finally, an elongated slide 64 is guided at the supporting plate so as to be displaceable in tabs 66 bent out of the supporting plate 14. The slide 64 has a cam 68 in its center area which cooperates with a sloping stop face 70 which is constructed at the second swivel arm 42 of the latch element 32. Further, the slide 64 is held via a pretensioned tension spring 72 in a first operating position from which the slide 64 can be lifted against the force of the spring 72. This can be effected e.g. by a locking button 73 which was indicated in FIG. 1. A connecting line 75 has been drawn in to demonstrate the connection between the locking button 72 and the slide 64. The locking button 73 is located in a known manner in the interior of the vehicle in the lower area of the window frame. However, it can also be replaced e.g. by a folding lever or the like provided in the area of the inner door handle. For a better understanding of the present invention it is important to know that the slide 64 can only be lifted from its shown operating position manually with the aid of the locking button 73 and from inside the vehicle.

The door handle 12 is constructed in the shown embodiment example as a so-called lever handle which can be folded out of the door 11 as a one-armed lever. The door handle 12 cooperates with a structural component part 74 which is in a working connection with the slide 64 via a line designated in FIG. 1 by 76. The line 76 is intended to demonstrate that the slide 64 can be lifted out of the operating position shown in FIG. 2 against the force of the spring 72 by actuating the door handle 12 in the direction of arrow 77 in FIG. 2. When the door handle 12 arrives back in its initial position, the slide 64 is drawn back again into its operating position shown in FIG. 2 by the force of the spring 72. Finally, the device according to the invention is provided with a lock unit 78 having an actuating motor 80 which is capable of swiveling a blocking element 84 via a spur wheel step-down gear unit 82.

In considering the lock unit 78 it is to be noted that it is shown rotated by 90 degrees. A key opening 86 (FIG. 2) arranged in the blocking element 84 must face the wall of the door 11.

Sensors 88, 90 and 92 are assigned to the structural component 74, the blocking element 84 and the slide 64, which sensors 88, 90 and 92 convey the respective operating position of these structural component parts to central control electronics 100 via control lines 94, 96 and 98. Other such sensors are assigned to the actuating element 50 and to the locking element 22. The control lines of these sensors, which are not visible in the drawing, are designated by 102 and 104. Finally, control lines 106 and 108 lead from the drive or lock motor 54 and the actuating motor 80 to the control electronics 100. A power take-off shaft 110 of the lock motor 54 is in a working connection with the shaft 52 of the crank-like actuating element 50 (line 55). All control lines 94, 96, 98, 102, 104, 106 and 108 are shown as cable trees for the other door locks 10 indicated in FIG. 1 and are provided with reference number 112.

Figure 3:
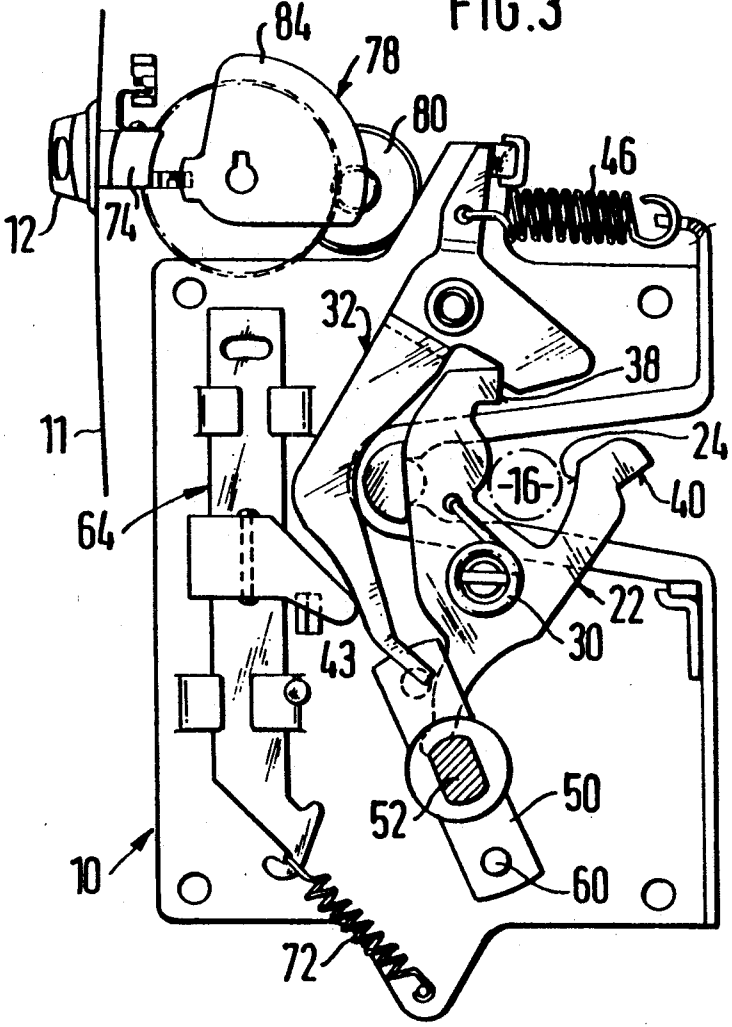
FIG. 3 shows the lock according to FIG. 2 drawn in operating position B.

The described locking and unlocking device operates as follows:

Proceeding from operating position A, shown in FIG. 2, the door can be closed manually. When the door is closed the closing pin 16 arrives in the cut out portion 24 of the locking element 22, which cut out portion 24 is open at the edge, and swivels the locking element 22 first into operating position B shown in FIG. 3 against the force of the leg spring 30. During this swiveling movement of the locking element 22, the latch element 32 is temporarily swiveled against the force of the tension spring 46 until the counter-catch means 36 of the first swivel arm 34 cooperates with the catch means 38 of the locking element 22. The resulting operating position B is shown in FIG. 3. The locking element 22 is further swiveled against the force of the leg spring 30 by pushing the door 11 further until it reaches operating position C shown in FIG. 4. In so doing, the latch element 32 is temporarily deflected against the force of the tension spring 46 until the counter-catch means 36 of the first swivel arm 34 cooperates with the catch means 40 of the hook-like arm 26 of the locking element 22. In this operating position, the door is closed and the locking element 22 is secured by the latch element 32. The operating position of the locking element 22 which is accordingly achieved is conveyed to the control electronics 100 which cause the actuating element 50 to be swiveled by 180 degrees in the direction of arrow 53 (FIG. 3). This happens already during the closing of the door as follows from the position of the actuating element 50 from FIG. 3. However, when the door is only brought into operating position B and the actuating element 50 then executes the movement just described, the lever 28 of the locking element 22 is carried along by the pin 62 so that the door 11 is pulled completely pulled shut by the lock motor 54, since the locking element 22 engages behind the locking pin 16 with its hook-shaped arm 26 and pulls it into the operating position C during the swiveling movement which takes place. Accordingly, it is clear that the door 11 can be closed manually as well as by motor. The opening of the driver's door in particular can likewise be effected manually as well as by motor. From the outside this is effected by actuating the door handle 12, since the mechanical connection of the component element 74 via the connecting line 76 to the slide 62 accordingly lifts the latter against the force of the spring 72. The cam 68 presses the second swivel arm 42 of the latch element 32 while abutting against the sloping surface 70 in the counterclockwise direction, so that the counter-catch means 36 disengage from the catch means 40. The pretensioning force of the leg spring 30 then swivels the locking element 22 into its operating position shown in FIG. 2 so that the closing pin 16 is released. The buffer 20 which is deformed when the door is closed presses the door slightly out of its closing position so that it can be pushed open from the inside or pulled open from the outside without difficulty.

The sensors assigned to the locking element 22 convey the current operating position of the latter to the control electronics 100 via the control line 102 and the lock motor 54 brings the actuating element 50 again into the operating position shown in FIG. 2. When the door is opened from the inside the slide 64 is likewise lifted via the connection indicated by line 75 (FIG. 1) by pulling the locking button 73 or by actuating a corresponding lever so that the sequence described above is carried out. If the door is now opened from the inside the lock motor 54 is activated, which swivels the actuating element 50 by 180 degrees. The pin 60 forming a shoulder strikes against a counter-shoulder 43 constructed at the second swivel arm 42 so that the latch element 32 is swiveled opposite the clockwise direction by motor. The counter-catch shoulder 36 also releases the catch shoulder 40 of the hook-like arm 26 of the locking element 22 so that the latter reaches the operating position A shown in FIG. 2 from its operating position C shown in FIG. 4.

In certain situations it is desirable to secure the doors of a motor vehicle in such a way that they cannot be opened from the outside, but can be opened from the inside without difficulty. For this purpose the device described here has the lock unit 78. If the doors are to be secured from the inside the actuating motor 80 is actuated, which swivels the blocking element 84 out of its operating position shown in FIG. 2 by approximately 90 degrees and guides it into the operating position shown in FIG. 5. The process is conveyed via the control line 96 to the control electronics 100. It can be seen from FIG. 6 that the door handle 12 is now blocked since the blocking element 84 impedes displacement of the component part 74. To simplify the device it is sufficient if only one vehicle door, e.g. the driver's door or its lock, respectively, has a lock unit 78. The other door locks can be constructed in the manner shown in FIG. 7. Instead of the lock unit 78, the door lock has only an electronic switch 120 which can be actuated via a door key. The electronic switch 120 has a movable component which is connected with a carrier 122 which can be rotated with the key. It cooperates with a magnetic structural component part 124 of the electronic switch 120. The switch 120 is undefined. If the carrier 120 is rotated, the signal to the central electronics 100 is changed. This then causes the activation of the lock motor 54 of every door in such a way that all actuating elements 50 are moved from their instantaneous operating position into the other operating position. Thus, if the actuating element 50 is located in its operating position shown in FIG. 2 it is brought into the operating position shown in FIG. 4 and vice versa.

Further, this door is automatically pulled shut and closed via the sensor at the locking element 22 when this door is located in the operating position B shown in FIG. 3. This is caused by the sensor which determines that the locking element 22 is located in its so-called lean-against position shown in FIG. 3. This applies to all the doors.

Figure 7:
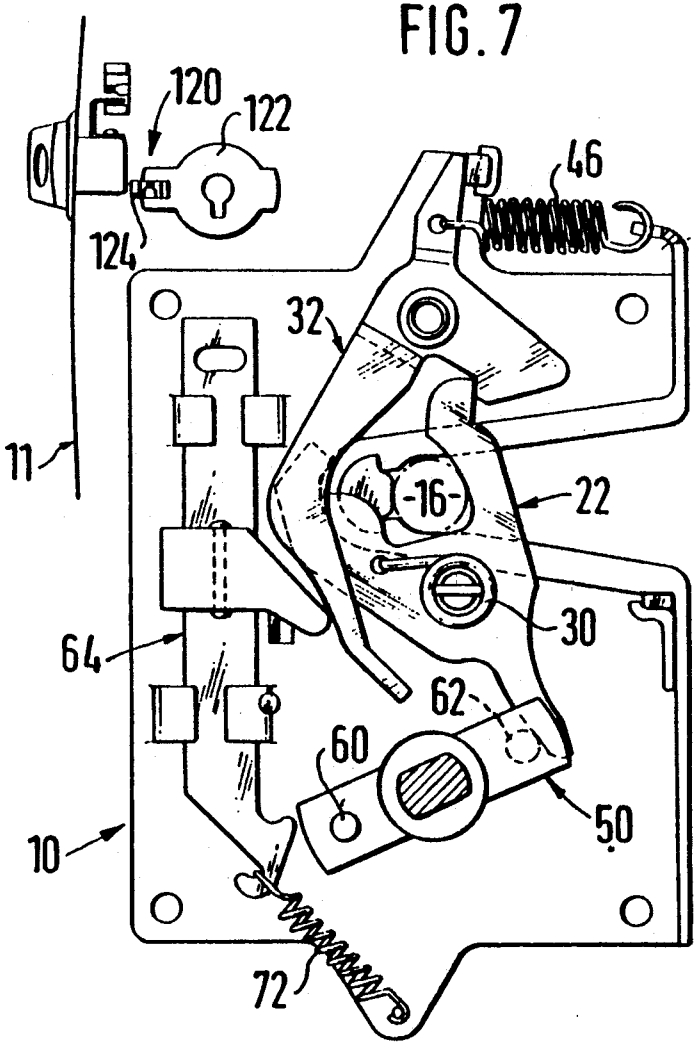
FIG. 7 shows another lock of the device in operating position E.
Figure 6:
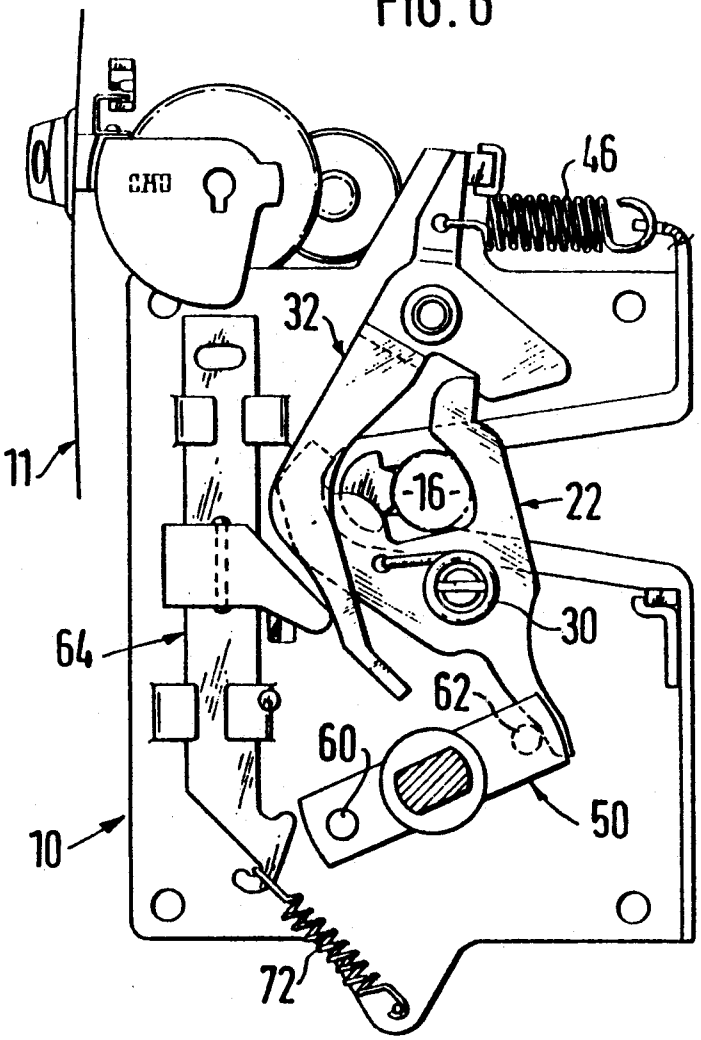
FIG. 6 shows the lock according to FIG. 2 in operating position E.

Finally, an anti-theft position (operating position E) shown in FIGS. 6 and 7 can also be adjusted. In this position, the locking element 22 is blocked by the pin 62 in its operating position shown in FIG. 4. This means that it cannot snap back into its operation position shown in FIG. 2 under the influence of the pretensioning of the leg spring 30 if the latch element 32 releases the locking element 22. Thus, in FIGS. 6 and 7 the anti-theft position designated in the beginning as operating position E is achieved. This operating position E can only be canceled by actuating the lock motor 54 to the extent that the lock has been described up to this point, since only the lock motor 54 is capable of guiding the actuating element 50 into a position in which it releases the locking element 22 again.

Figure 4:
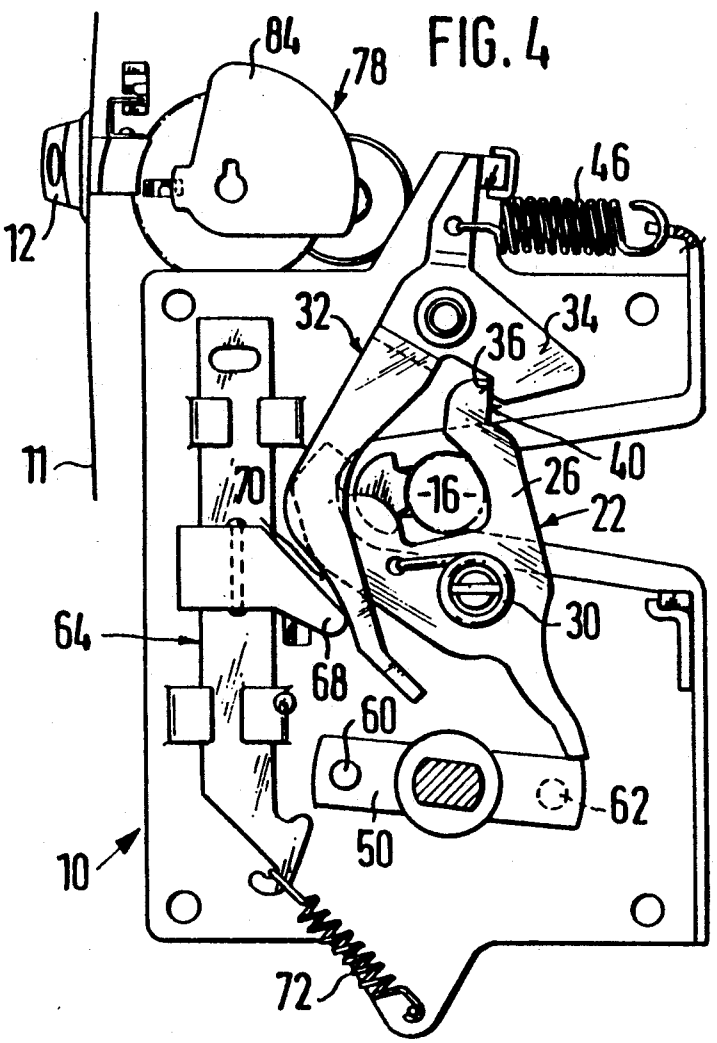
FIG. 4 shows the lock according to FIG. 2 in operating position C, the actuating element does not block the locking element.
Figure 10:
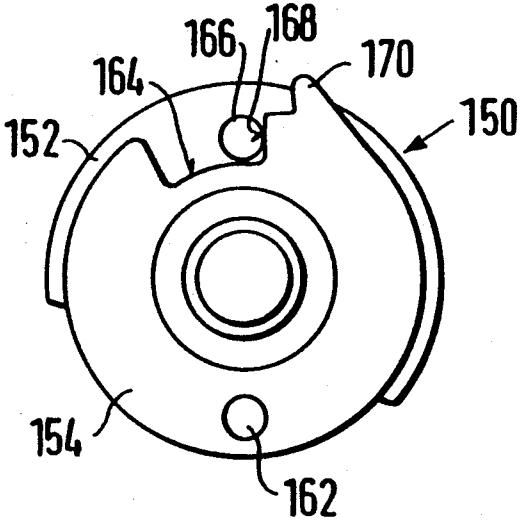
FIG. 10 shows a view of the actuating element in the direction of arrow X in FIG. 9.
Figure 9:
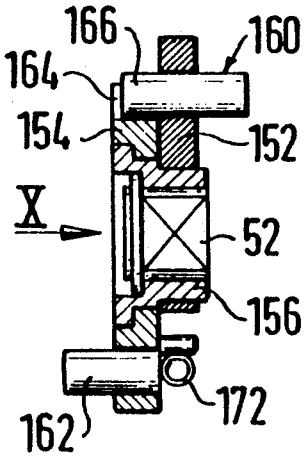
FIG. 9 shows a section through the actuating element according to FIG. 8 along line IX—IX.
Figure 8:
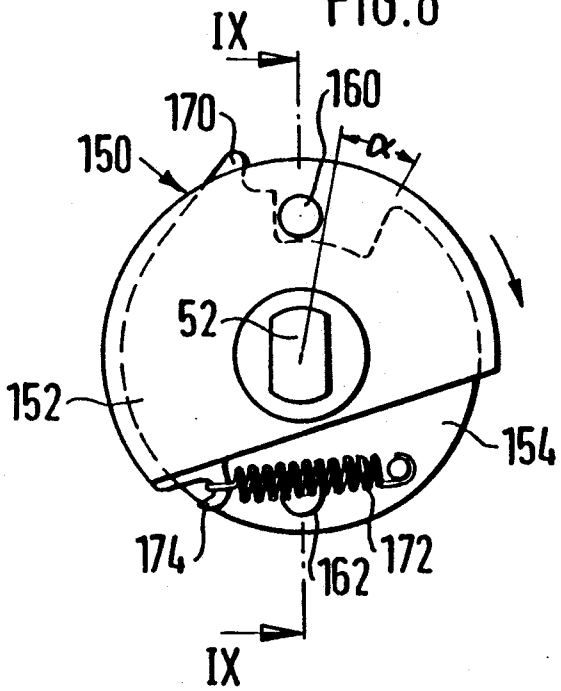
FIG. 8 shows a top view of a two-part actuating element belonging to the device.
Figure 12:
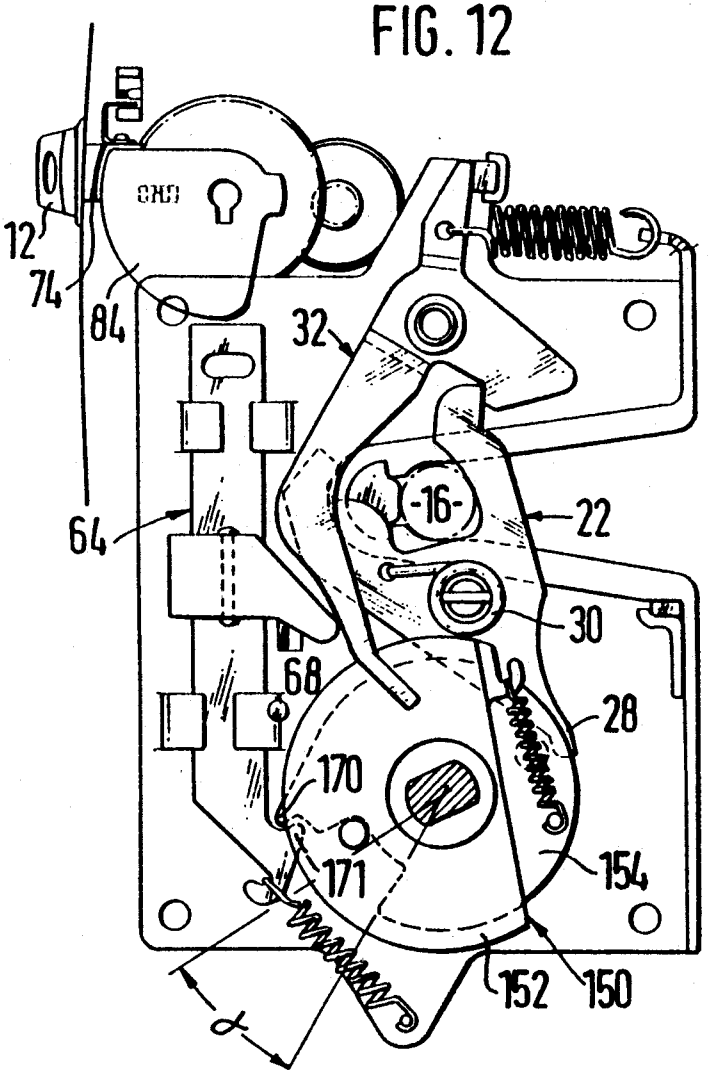
FIG. 12 shows the lock according to FIG. 5 with the actuating element according to FIGS. 8 to 10.
Figure 11:
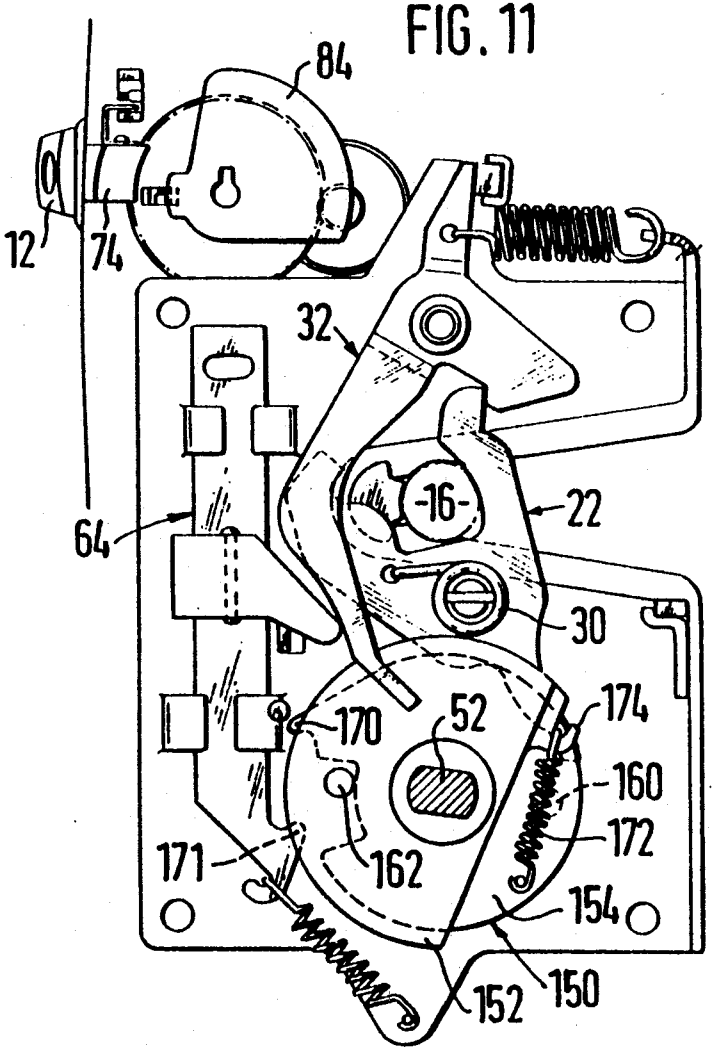
FIG. 11 shows the lock according to FIG. 4, but with the use of the actuating element shown in FIGS. 8 to 10.
Figure 13:
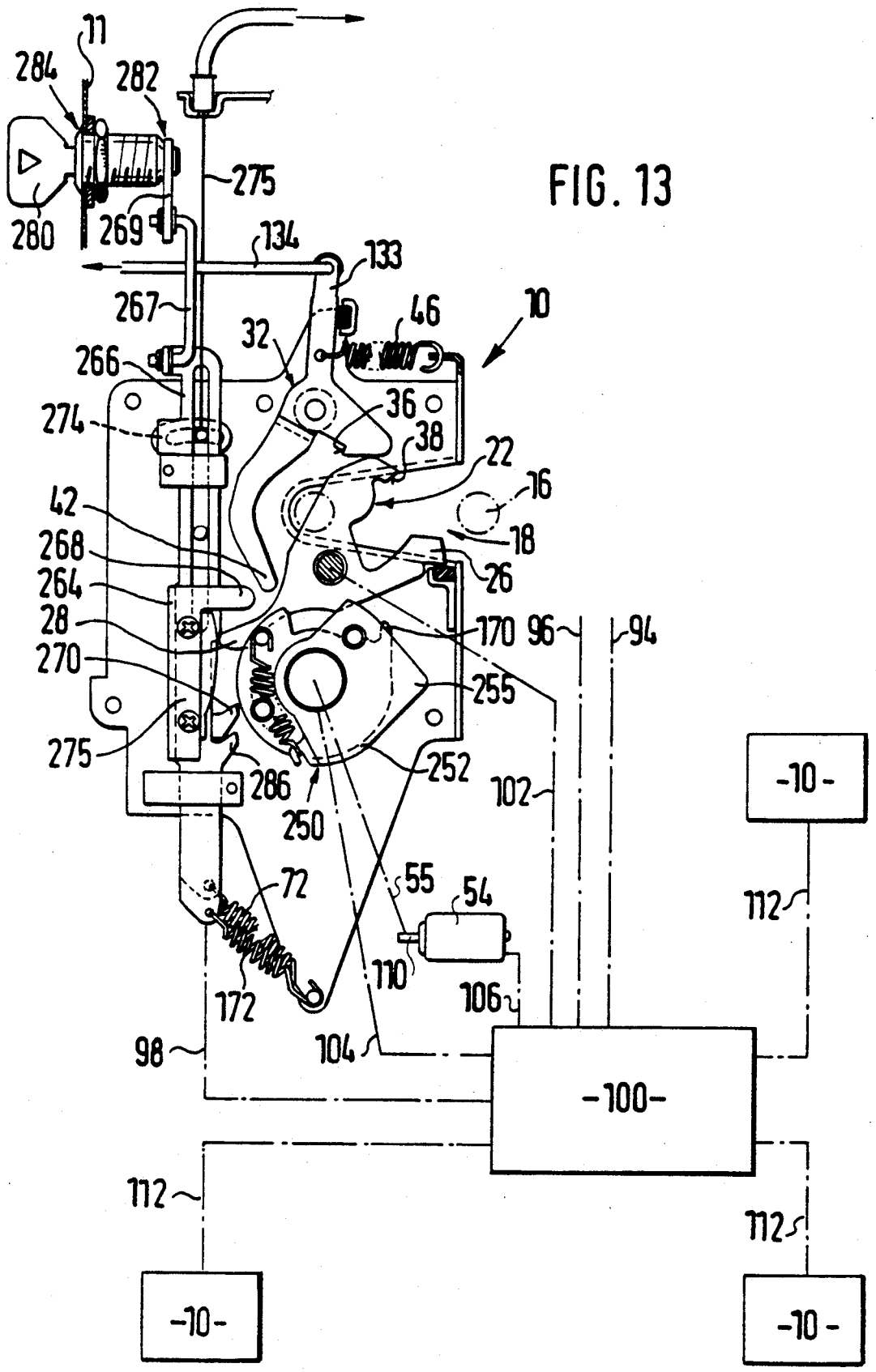
FIG. 13 shows another embodiment form of the invention whose operating position corresponds to the operating position shown in FIG. 1.
Figure 15:
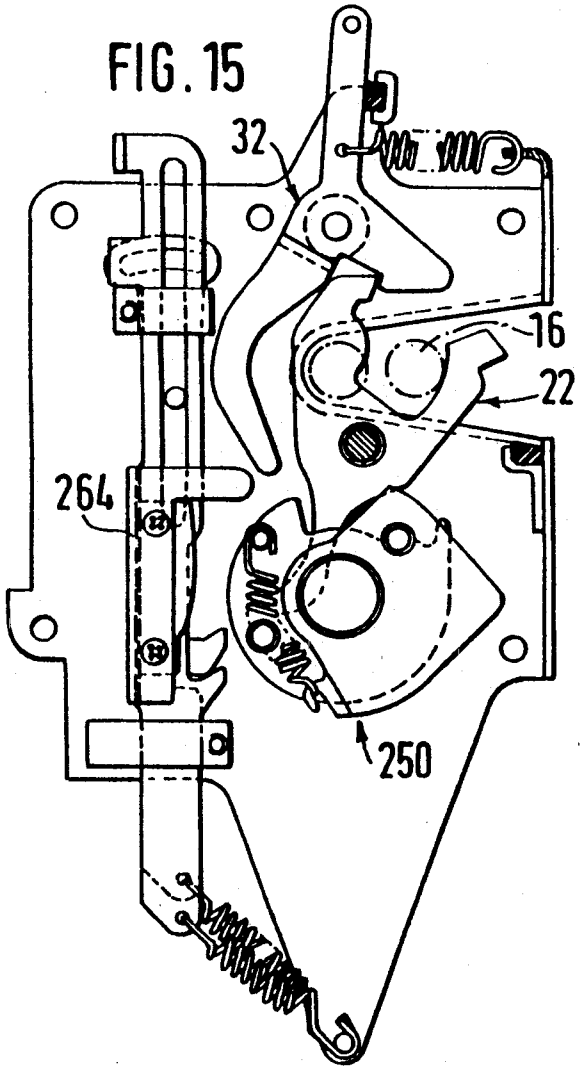
FIGS. 14 to 18 show operating positions of the embodiment form according to FIG. 13 which correspond to the operating positions shown in FIGS. 2 to 6.
Figure 14:
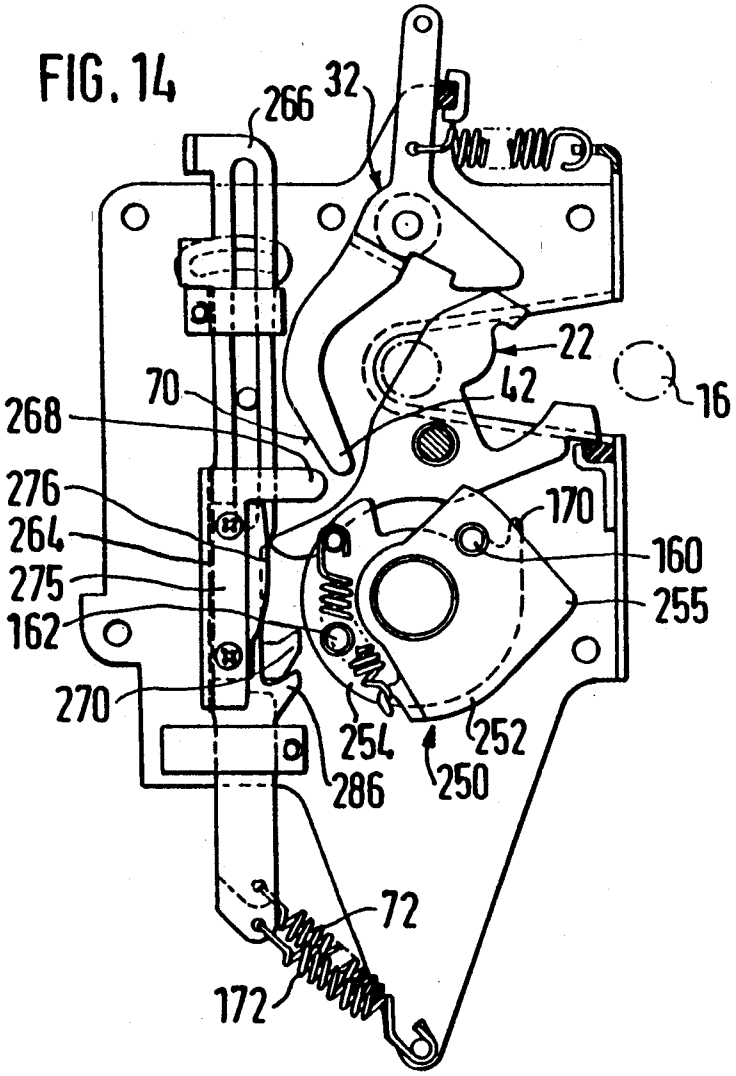
Figure 17:
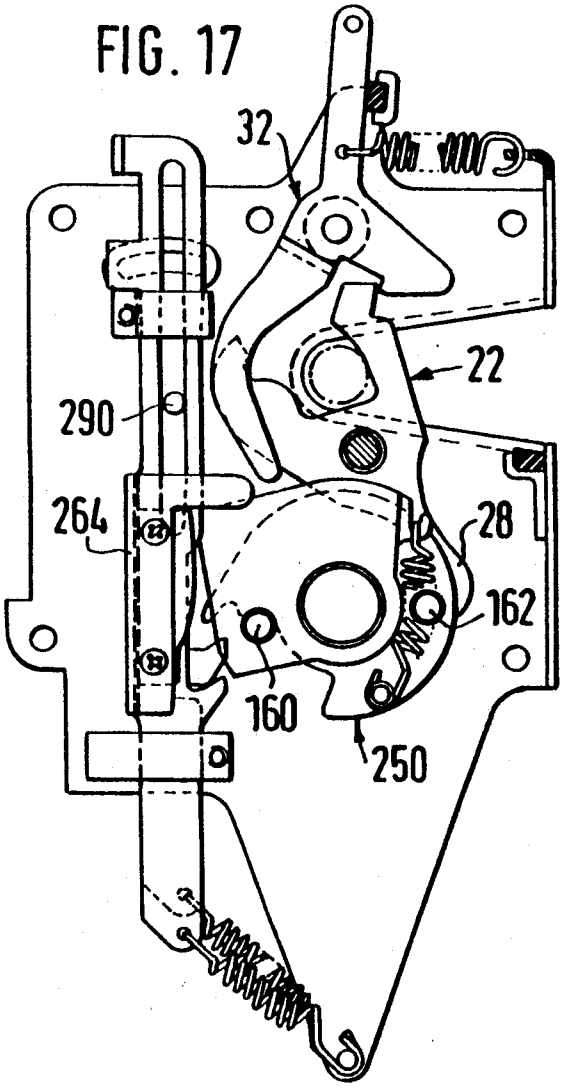
Figure 16:
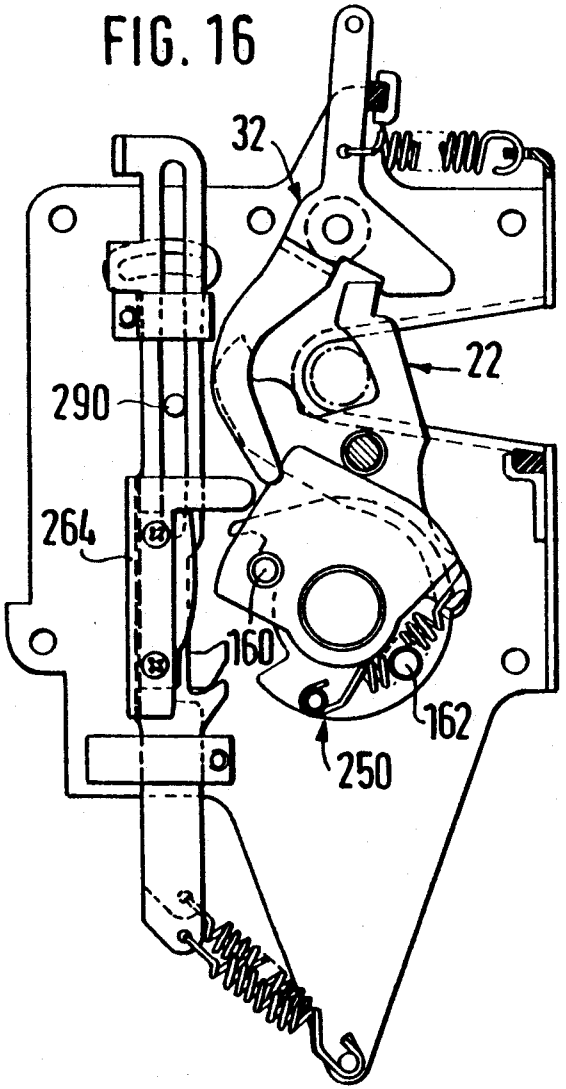
Figure 19:
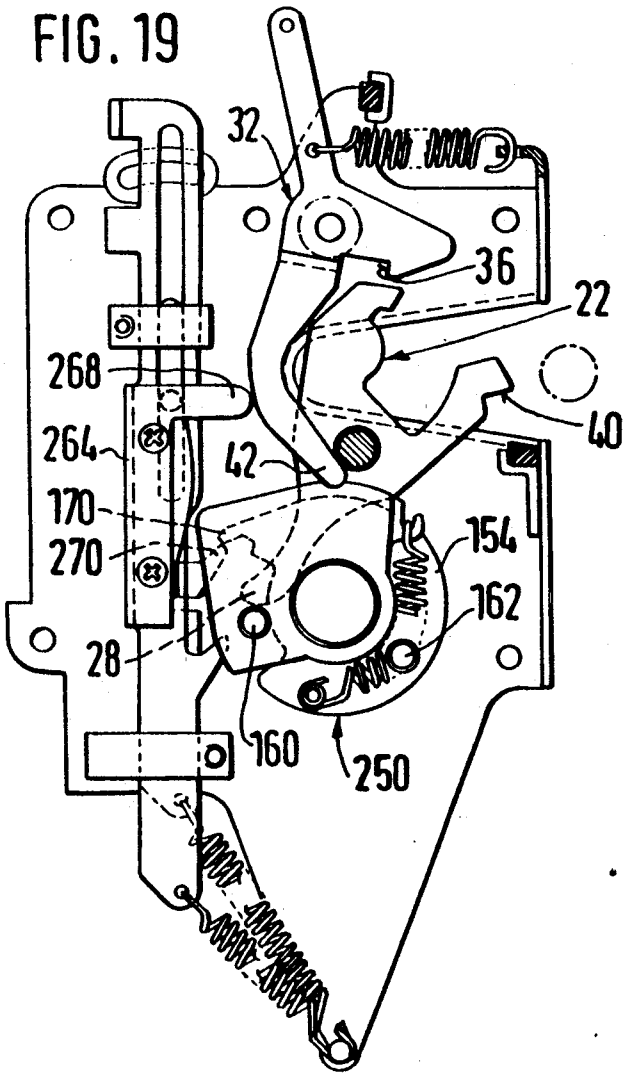
FIG. 19 shows the unlocking position from the operating position shown in FIG. 17 with the handle actuated in the passenger compartment.

However, to make it possible to open the door manually without difficulty during a failure of the electrical system of the motor vehicle, the actuating element 50 is constructed in the manner shown in FIGS. 8 to 10. In FIGS. 11 and 12, the door lock 10 on the driver's door is shown with this special actuating element 150. In both cases the locks are located in the operating positions already discussed. FIG. 11 shows an operating position as shown in FIG. 4. FIG. 12, on the other hand, shows a locking position such as has been discussed already with reference to FIG. 6. This special actuating element 150 is constructed according to FIGS. 8 to 10 from two partial elements 152 and 154. One partial element 154 is connected with the shaft 52 so as to be fixed with respect to rotation relative to it. The other partial element 154 on the other hand is rotatable relative to the shaft 52 because it is guided on a stepped sleeve 156 which is connected with the shaft 52 so as to be fixed with respect to rotation relative to it. One partial element 152 has a pin 160, while the other partial element 154 is provided with a pin 162. Both pin 160 and pin 162 correspond to the structural component parts 60 and 62 which have been described with reference to the previously described Figures. Further, the partial element 154 has a segment-like cut out portion 164 which is open at the edge, a driving prolongation 166 of the pin 160 projecting into the latter. One wall 168 of the cut out portion 164 serves as a driver for the driving prolongation 166 of the pin 160. Finally, the other partial element 154 has a hook-shaped projection 170 which can cooperate with a counter-hook 171 of the slide 64 if the two-part actuating element 150 according to FIGS. 8 to 10 is rotated opposite the clockwise direction (FIG. 12). During normal operation the driving prolongation 166 of the pin 160 is held against the driver face 168 of the cut out portion 164, which is open at the edge, by a pretensioned tension spring 172. For this purpose the tension spring 172 is mounted at a hook 174 with one of its ends at one structural component element 152, while its other end is fixed at the other partial element 154. The other partial element 154 is rotatable against the pretensioning force of the tension spring 172 relative to one partial element 152 by a determined angle $\alpha$ which is determined by the arc length of the cut out portion 164 which is open at the edge and by the diameter of the driving prolongation 166. The pin 160 extends out of the one partial element 152 in such a way that it can cooperate with the lever 28 of the locking element 22. The pin 162 on the other hand substantially corresponds to the pin 62 according to the embodiment form shown in FIG. 2 and cooperates with the second swivel arm 42 of the latch element 32. With reference to the axis of rotation of the shaft 52, the pin 162 and the pin 160 are located diametrically opposite one another when the tension spring 172 holds the driving prolongation 166 of the pin 160 against the driver face 168 of the cut out portion 162 of the other partial element 154, which cut out portion 162 is open at the edge. Further, the other partial element 154 has a hook-like projection 170 which is capable of cooperating with the counter-hook 171 of the slide 64 when the actuating element 150 is rotated opposite the clockwise direction. When the lock 10 is located in the operating position shown in FIG. 12 in which operating position E is shown, the pin 162 blocks the lever 28 of the locking element 22. During a failure of the electrical system of the motor vehicle, the vehicle can be opened manually without difficulty as follows:

The blocking element can be rotated out of its blocking position according to FIG. 12 into an operating position via the door lock with the aid of the key or some other auxiliary means as is shown e.g. in FIGS. 1 to 4. This is possible because the step-down gear unit 82 is constructed as a spur wheel gear unit. The door handle can then be manually actuated so that the slide 64 is lifted against the force of the spring 72 via the connection 76. The cam 68 of the slide 64 lifts the securing element 32 from its catching position relative to the locking element 22 and the two hook constructions 171 and 170 of the slide 64 and the other partial element 154 simultaneously cooperate with one another in such a way that the other partial element 154 is swiveled in the clockwise direction by an amount made possible by the arc length or angle $\alpha$ of the segment-like cut out portion 164 which is open at the edge. This arc measurement is dimensioned in such a way with respect to the diameter of the driving prolongation 166 that the pin 162 releases the lever 28 of the locking element 22. The locking element 22 accordingly jumps into its position shown in FIG. 2 in which the door is opened under he influence of the pretensioning of the leg spring 30. All of these special constructions make it possible to achieve the door or lock positions A, B, C, D and E by motor in a door lock of the type described here. Further, it remains a completely open possibility to close the doors manually both from the outside and from the inside. Operating position D also enables an easy opening of the door from the inside. Finally, operating position E provides the possibility of opening the door either by motor or manually without the vehicle key.

A particularly simple embodiment form of the device according to the invention is discussed in the following with reference to FIGS. 13 to 21. In this construction the lock unit 78, including the respective component elements 80, 84, 90, 96, 108 and 74 according to the construction already described, is dispensed with. Since all other structural component parts of this construction—with the exception of the actuating element 150 and the slide 64—correspond to the construction described above, the designations and reference numbers used for the latter are retained in the following. However, the latch element 32 differs slightly from the latter insofar as its second swivel arm 42 is shortened so that the counter-shoulder 43 is dispensed with. A possible unintentional opening of the door 11 is accordingly prevented in determined operating situations.

The actuating element 250 (FIGS. 13 to 21) has a deflecting cam 255 at one of its partial elements 252 which cooperates with a slide 264 which takes the place of the slide 64 of the described construction. The slide 264 is constructed in a U-shaped manner in cross section in the area adjacent to the actuating element 250. The two U-legs engage around a second slide 266 which is longitudinally displaceable independently from the first slide 264. One leg of the slide 264, the lower leg in FIGS. 13 to 20, has a hook projection 270 which corresponds to the hook construction 171 of the other embodiment form. The upper U-leg 275 has a cam 268 which takes over the function of the cam 68 of the first construction and accordingly cooperates with the swivel arm 42 of the latch element 32 when the slide 264 is displaced against the force of the pretensioned spring 72. For this purpose at the end of the slide 264 remote of the spring 72 in an elongated hole 274 in which one end of a Bowden cable 275 is mounted which can be actuated by a handle, e.g. the locking button 73, (FIG. 1) located in the passenger compartment of the motor vehicle [Translator's Note: The preceding paragraph is a literal translation. There may be missing text in the original German]. The other, second slide 266 is likewise loaded in its longitudinal direction via a pretensioned tension spring 172. Its end remote of the spring 172 is in a working connection with a crank 269 via a rod linkage 268, which crank 269 is fastened at the closing cylinder 282 of a closing device 284 belonging to the door 11, which closing cylinder 282 can be rotated by a key 280. Finally, the second slide 266 is provided with a hook projection 286. The two hooks 270 and 286 of the two slides 264 and 266 are located in closely adjacent planes which extend within the plane of the partial element 254 with its hook-shaped projection 170. The deflecting cam 255 of the partial element 252 is arranged in such a way that it cooperates with the leg 275 of the slide 264. The leg 275 is equipped in this area with a plastic sliding piece 276 (FIG. 21) so that no undesirable operating noises occur. Further, the pin 160, which has already been described, is arranged in such a way with respect to the deflecting cam 255 that an operating position results, also when the slide 264 is deflected, in which the pin 160 blocks the locking element 22 in its operating position shown in FIG. 18 because it contacts the counter-shoulder which is constructed at the second swivel arm 42 of the locking element 22 and is formed by the lever 28. The latch element 32 is provided with an actuating lever 133 at which the handle 12 arranged on the outside of the door 11 (FIG. 1) acts via a rod linkage 134. When the handle 12 is actuated, the latch element 32 is swiveled in the counterclockwise direction via the rod linkage 134 and the actuating lever 133 so that the catch and counter-catch means 38, 40, 36 disengage from the latch element 32 and the locking element 22.

The operation of the embodiment form according to FIGS. 13 to 21 is explained in the following with reference to the drawing. The lock actuation from the operating position according to FIGS. 13 and 14 (open or unlocking position A) into the positions according to FIG. 15 (lean-against position B, which also shows the lock during the closing process) and FIG. 16 (locking position C) corresponds completely to the already described actuation according to FIGS. 3 and 4. This also applies to achieving the operating positions according to FIGS. 17 (central locking D) and 18 (anti-theft E) by a motor.

The canceling of position D from the passenger compartment of the motor vehicle is effected as follows: when the handle (inner handle or unlocking button) located in the passenger compartment is actuated, the Bowden cable 275 pulls the slide 264 up, its hook 270 engages with the hook construction 170 of the other partial element 154 of the actuating element 250 so that the latter is rotated in the clockwise direction and the pin 160 releases the lever 28 of the locking element 22. The cam 268 of the slide 264 simultaneously runs against the sloping surface 70 of the second swivel arm 42 of the latch element 32 and swivels it in the counterclockwise direction so that the latch element 32 releases the locking element 22 since the catch and counter-catch means 40 and 36 disengage. The central locking at the respective door is accordingly canceled from inside.

Figure 18:
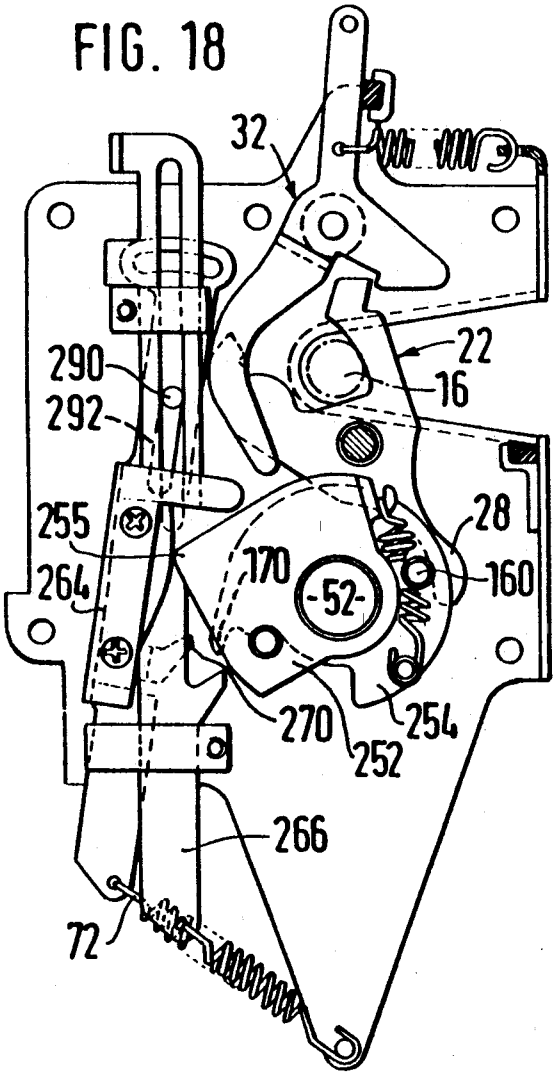
Figure 21:
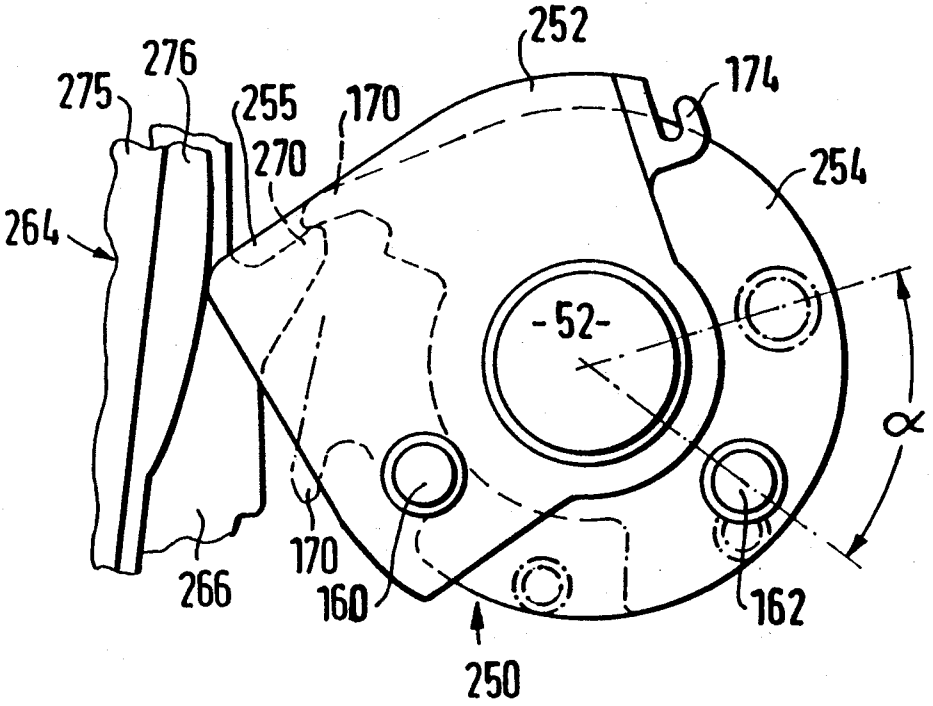
FIG. 21 shows the actuating element of the embodiment form according to 13 in an enlarged view and in the operating position shown in FIG. 20.

The action of the so-called anti-theft safety (E) is effected in this embodiment form in that—as shown in FIG. 18—the sliding bar 264 has been removed from the shaft 52 of the actuating element 250 by the deflecting cam 255 of one partial element 252 far enough so that the hook 270 of the sliding bar 264 is located outside the orbit of the hook construction 170 of the other partial element 154. The deflecting cam 255 has pushed away the sliding bar 264 against the force of the tension spring 72. A defined position of the sliding bar 264 is achieved by a guide pin 290 which is fixed with respect to the frame and engages in a longitudinal slot 292 of the sliding bar 264. In this operating position, the respective door can be opened neither from the inside nor from the outside because, although an actuation of the outer handle or outer button swivels the latch element 32 in the counterclockwise direction so that the locking element 22 is released by the latch element 32, the locking element 22 remains blocked by the pin 160 of the other partial element 254. When the inner handle is actuated the Bowden cable 275 pulls up the siding bar 264, but its hook 270 and the hook construction 170 do not engage so that the blocking of the locking element 22 can also not be canceled in this way. Thus, the locking element 22 still engages behind the closing pin 16 serving as retaining means.

Figure 20:
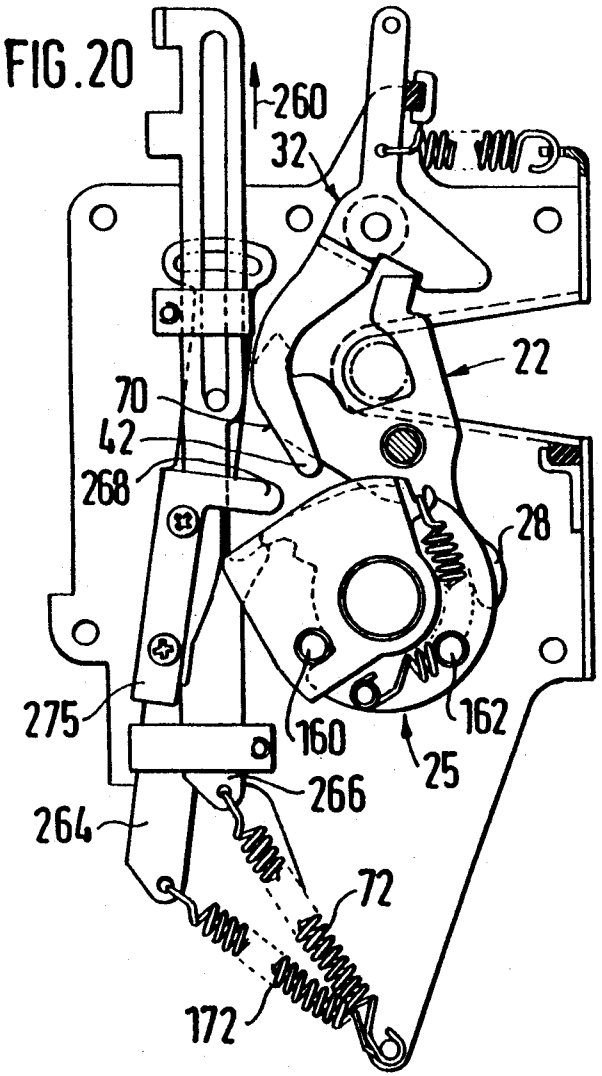
FIG. 20 shows the unlocking position from the operating position shown in FIG. 18 when a motor drive actuating the lock is not operational.

However, in the event that the electrical supply of the vehicle fails in this operating position (E), e.g. due to a discharging of the vehicle battery, the anti-theft position can be canceled mechanically as is shown in FIG. 20. The second slide 266 is moved up in the direction of the arrow 260 by rotating the closing cylinder 282 of the closing device 284 with the key 280 by 180° via the crank 269 and a rod linkage 267, its hook 286 which cooperates with the hook 170 of the partial element 254 rotates it in the clockwise direction over an angle $\alpha$ until the pin 260 releases the locking element 22 and the door can be opened.

It will be understood that each of the elements described above, or two or more together, may also find a useful application in other types of constructions differing from the types described above.

While the invention has been illustrated and described as embodied in a device for locking and unlocking closed doors to the interior of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for locking and unlocking closed doors to an interior of a motor vehicle, comprising a lock mountable to every door and actuatable by a key, said lock having a locking element swivelably supportable at a door and having retaining means cooperatable with the door and arranged near a door opening so as to be fixed with respect to a vehicle body, said locking element being swivelable with respect to a swivel axis and having two catching means which together enclose an angle with respect to said swivel axis; a latch element having counter-catch means and spring-loaded relative to a catch position, said catching means of said locking element cooperating with said counter-catch means of said latch element; a motor-activated actuating element which swivels said locking element into said locking position for locking the door and moves said latch element against a spring force for unlocking the door and in so doing disengages said catching means and said counter-catch means; a lock motor having a power take-off shaft, said actuating element being a crank which is a working connection with said power take-off shaft and having a stop at a distance from its axis of rotation and also a shoulder, said locking element having a counter-stop with which said stop cooperates, said latch element having a counter-shoulder with which said shoulder cooperates, said crank having two crank arms, one of said crank arms being provided with a stop, the other of said crank arms being provided with a shoulder.

2. A device for locking and unlocking closed doors to an interior of a motor vehicle, comprising a lock mountable to every door and actuatable by a key, said lock having a locking element swivelably supportable at a door and having retaining means cooperatable with the door and arranged near a door opening so as to be fixed with respect to a vehicle body, said locking element being swivelable with respect to a swivel axis and having two catching means which together enclose an angle with respect to said swivel axis; a latch element having counter-catch means and spring-loaded relative to a catch position, said catching means of said locking element cooperating with said counter-catch means of said latch element; a motor-activated actuating element which swivels said locking element into said locking position for locking the door and moves said latch element against a spring force for unlocking the door and in so doing disengages said catching means and said counter-catch means; a lock motor having a power take-off shaft, said actuating element being a crank which is a working connection with said power take-off shaft and having a stop at a distance from its axis of rotation and also a shoulder, said locking element having a counter-stop with which said stop cooperates, said latch element having a counter-shoulder with which said shoulder cooperates, said crank having a circumferentially plane, said stop projecting out of said circumferential plane to one side and said shoulder projecting out of said circumferential plane toward the other side.

3. A device for locking and unlocking closed doors to an interior of a motor vehicle, comprising a lock mountable to every door and actuatable by a key, said lock having a locking element swivelably supportable at a door and having retaining means cooperatable with the door and arranged near a door opening so as to be fixed with respect to a vehicle body, said locking element being swivelable with respect to a swivel axis and having two catching means which together enclose an angle with respect to said swivel axis; a latch element having counter-catch means and spring-loaded relative to a catch position, said catching means of said locking element cooperating with said counter-catch means of said latch element; a motor-activated actuating element which swivels said locking element into said locking position for locking the door and moves said latch element against a spring force for unlocking the door and in so doing disengages said catching means and said counter-catch means; a lock motor having a power take-off shaft, said actuating element being a crank which is a working connection with said power take-off shaft and having a stop at a distance from its axis of rotation and also a shoulder, said locking element having a counter-stop with which said stop cooperates, said latch element having a counter-shoulder with which said shoulder cooperates, said locking element having a lever provided with said counter-stop and located substantially opposite to said hook-shaped projection with respect to a swivel axis of said locking element, said counter stop extending into an orbit of said stop where the respective vehicle door is located inn a lean-against position.

4. A device for locking and unlocking closed doors to an interior of a motor vehicle, comprising a lock mountable to every door and actuatable by a key, said lock having a locking element swivelably supportable at a door and having retaining means cooperatable with the door and arranged near a door opening so as to be fixed with respect to a vehicle body, said locking element being swivelable with respect to a swivel axis and having two catching means which together enclose an angle with respect to said swivel axis; a latch element having counter-catch means and spring-loaded relative to a catch position, said catching means of said locking element cooperating with said counter-catch means of said latch element; a motor-activated actuating element which swivels said locking element into said locking position for locking the door and moves said latch element against a spring force for unlocking the door and in so doing disengages said catching means and said counter-catch means; a lock motor having a power take-off shaft, said actuating element being a crank which is a working connection with said power take-off shaft and having a stop at a distance from its axis of rotation and also a shoulder, said locking element having a counter-stop with which said stop cooperates, said latch element having a counter-shoulder with which said shoulder cooperates, said latch element having a first swivel arm carrying said counter-catch means and a second swivel arm carrying said counter shoulder, said counter shoulder extending into an orbit of said shoulder in every operating position of the door lock; a slide movable in a longitudinal direction between a first operating position and a second operating position and having a cam; and a handle swivelling said latch element against a spring force both outside and inside the door so that said catch and counter-catch means of said locking element and said latch element is engaged, said second swivel arm of said latch element having a stop face projecting into an orbit of said cam in such a way that said slide passes from said first operating position to said second operating position and said cam swivels said latch element against a spring force when the door and said handle are located in one of two closing states.

5. A device for locking and unlocking closed doors to an interior of a motor vehicle, comprising a lock mountable to every door and actuatable by a key, said lock having a locking element swivelably supportable at a door and having retaining means cooperatable with the door and arranged near a door opening so as to be fixed with respect to a vehicle body, said locking element being swivelable with respect to a swivel axis and having two catching means which together enclose an angle with respect to said swivel axis; a latch element having counter-catch means and spring-loaded relative to a catch position, said catching means of said locking element cooperating with said counter-catch means of said latch element; a motor-activated actuating element which swivels said locking element into said locking position for locking the door and moves said latch element against a spring force for unlocking the door and in so doing disengages said catching means and said counter-catch means; a lock motor; and a shaft driven by said lock motor, said actuating element having two partial elements located one after the other in direction of its swivel axis, one of said partial elements having a driver and being connected with said shaft so as to be fixed with respect to rotation relative to said shaft, the other of said partial elements being rotatable about a swivel axis against a pretensioning with respect to said one partial element along an angle and also having a drive, so that said driver of said other partial element is held by spring force against said driver of said one partial element.

6. A device as defined in claim 1, wherein said retaining means being formed as pin-like retaining means, said locking element engaging behind said pin-like retaining means in said locking position.

7. A device as defined in claim 1, wherein said latch element has a first swivel arm carrying said counter-catch means and a second swivel arm carrying said counter shoulder, said counter shoulder extending into an orbit of said shoulder in every operating position of the door lock.

8. A device as defined in claim 1; and further said lock motor rotates in a same first rotating direction for achieving said locking position and said unlocking position and is switchable off after a rotational angle of substantially 180°.

9. A device as defined in claim 4; and further comprising a blocking element which blocks said handle in said first operating position and releases said handle in said second operating position; and a lock unit which is in a working connection with said blocking element.

10. A device as defined in claim 9; and further comprising an electric motor which actuates said lock unit.

11. A device as defined in claim 10; and further comprising a step-down gear unit arranged between said electric motor of said lock unit and said blocking element.

12. A device as defined in claim 11, wherein said step-down gear unit is formed as a spur wheel gear unit.

13. A device as defined in claim 5, wherein said carrier of said one partial element is formed as a prolongation of a stop, said other partial element having an axially parallel recess at which said driver is formed and in which said prolongation extends.

14. A device as defined in claim 13, wherein said stop is formed as pin extending through said one partial element in direction of a swivel axis of said actuating element, said pin having one end which forms a stop cooperating with said locking element and also other end which is formed as said carrier.

15. A device as defined in claim 13, wherein said other partial element has a pin extending away from said one partial element and directed parallel to a swivel axis, said pin forming a shoulder, said latch element having a counter-shoulder with which said shoulder of said pin cooperates.

16. A device as defined in claim 5, wherein said driver of said other partial element is formed at a wall of a segment-like cutout portion which is open at an edge.

17. A device as defined in claim 16, wherein said cutout portion has a length which is dimensioned in such a way, as seen in a swiveling direction of said other partial element, that said other partial element can be swiveled in said swiveling direction at an angle relative to one partial element.

18. A device as defined in claim 16; and further comprising means providing a spring force which holds said carrier and said wall acting as said driver which lies in a front in a swiveling direction of said actuating element.

19. A device as defined in claim 17; and further comprising another wall located in the rear in the swiveling direction of said actuating element and defining a relative swivel between said two partial elements.

20. A device as defined in claim 4; and further comprising a common supporting plate which supports said locking element, said latch element, said actuating element and said slide.

21. A device as defined in claim 5; wherein said slide is spring loaded relative to its first operating position and is fastenable to this position by said blocking element when said blocking element arrives in a third operating position.

22. A device as defined in claim 21, wherein said other partial element has a hook-like projection, said slide having a hook-like projecting portion at its end facing said first operating position, said hook-like projecting portion projecting into an orbit of said hook-like projection of said other partial element.

23. A device as defined in claim 21, wherein said other projecting portion engaging with said projection when said actuating element is swiveled opposite to said first rotating direction.

24. A device as defined in claim 9; and further comprising a central control electronic unit; and a plurality of sensors which convey every possible operating position of said locking element, said actuating element and said slide to said central control electronic unit.

25. A device as defined in claim 9; and further comprising further sensors which convey every possible operating position of said blocking element to said central control electronic unit.

26. A device as defined in claim 25; and further comprising still further sensors which convey every possible operating position of said handle arranged at the outside of the door to said central control electronic unit.

27. A device as defined in claim 24; and further comprising a lock motor connected with said actuating element and being in a line connection with said central control electronic unit.

28. A device as defined in claim 4; and further comprising a deflecting cam arranged at an edge area of one of said partial elements and removing said slide from said shaft of said actuating elements; a closing device arranged at the vehicle door and displaceable in its longitudinal direction, said closing device having a manually rotatable part; and a second slide connected with said manually rotatable part of said closing device and engaging with said other partial element during its longitudinal displacement; and a transmission means through which said second slide is connected with said manually rotatable part.

29. A device as defined in claim 28, wherein said second slide has a hook construction, said other element also having a hook construction with which said hook construction of said second slide engages.

30. A device as defined in claim 29; and further comprising a door opener at the outside of the door; and movement transmission means, said latch element being connected by said movement transmission means with said door opener so that said catch and counter-catch means disengage when said door opener is actuated.

31. A device as defined in claim 29; and further comprising a counter-stop fixable to a frame of the door and facing said closing device, said second slide having a stop contacting said counter-stop.

32. A device as defined in claim 31; and further comprising a handle adapted to be arranged in a passenger compartment, said first mentioned slide being in a working connection with said handle.

33. A device as defined in claim 29, wherein said lock has a supporting plate, said slide being guided at said supporting plate of said lock.

34. A device as defined in claim 29; and further comprising a lever and a stop, said stop locking said locking element in its locking position via said lever in a position in which said deflecting cam cooperates with said first mentioned slide.

35. A device as defined in claim 30, wherein said door opener is a key which actuates said closing device.

* * * * *